United States Patent [19]

Dziedzic et al.

[11] 4,130,160

[45] Dec. 19, 1978

[54] COMPOSITE CERAMIC CELLULAR STRUCTURE AND HEAT RECUPERATIVE APPARATUS INCORPORATING SAME

[75] Inventors: Chester J. Dziedzic; Joseph J. Cleveland, both of Dushore, Pa.

[73] Assignee: GTE Sylvania Incorporated, Stamford, Conn.

[21] Appl. No.: 726,950

[22] Filed: Sep. 27, 1976

[51] Int. Cl.[2] ..... F28F 3/00

[52] U.S. Cl. ..... 165/166; 65/33; 432/223

[58] Field of Search ..... 165/166; 65/33; 432/219, 223

[56] References Cited

U.S. PATENT DOCUMENTS

| | | | |
|---|---|---|---|
| 1,662,870 | 3/1928 | Stancliffe | 165/166 |
| 2,733,287 | 1/1956 | Schauble et al. | 432/219 X |
| 3,940,301 | 2/1976 | Straw et al. | 165/166 |
| 3,948,317 | 4/1976 | Moore | 65/33 |

*Primary Examiner*—John J. Camby
*Attorney, Agent, or Firm*—John C. Fox

[57] ABSTRACT

Layered composite cross-flow ceramic recuperators having minimal leakage between layers and consequent high efficiencies are utilized for industrial waste heat recovery in an apparatus in which the ceramic recuperator is surrounded by a metallic housing adapted for coupling to the metallic fittings of existing furnaces, calciners, ovens and preheaters. The ceramic recuperators are formed from stacks of bi-sectioned ribbed layers, the sections of each layer being sealed together to minimize leakage of the heat transfer fluids between layers, and thus to increase the efficiency of the heat transfer.

16 Claims, 7 Drawing Figures

Fig. 1
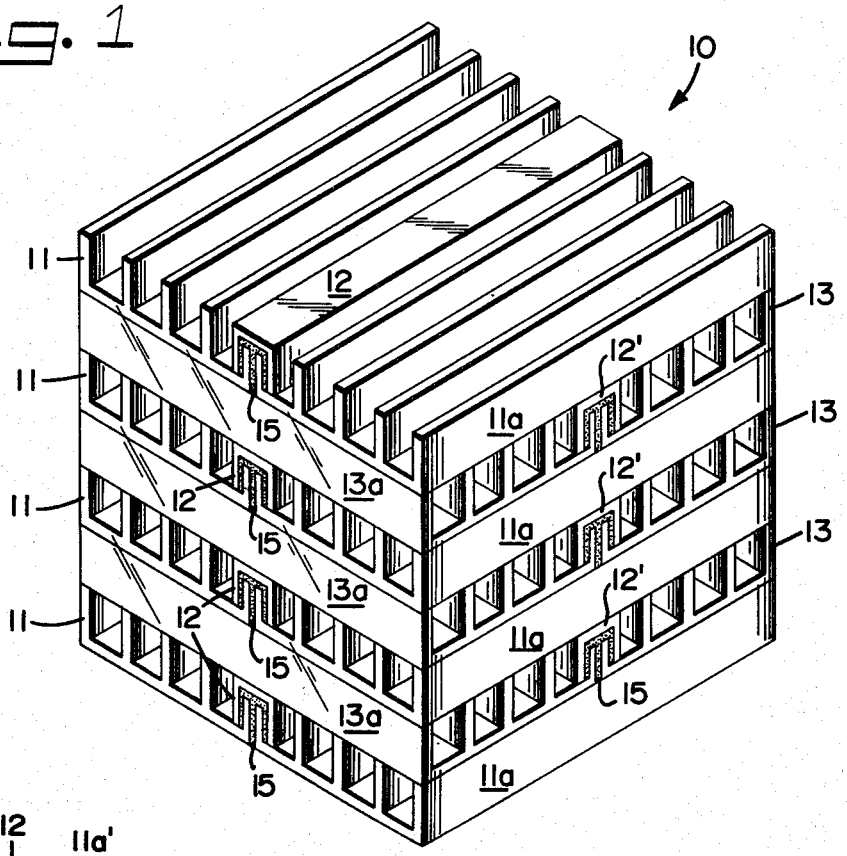
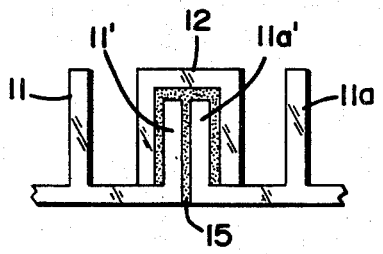
Fig. 2
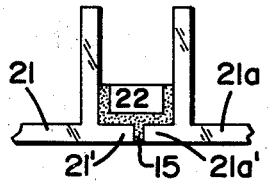
Fig. 3
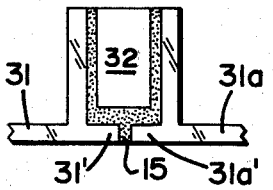
Fig. 4
Fig. 5
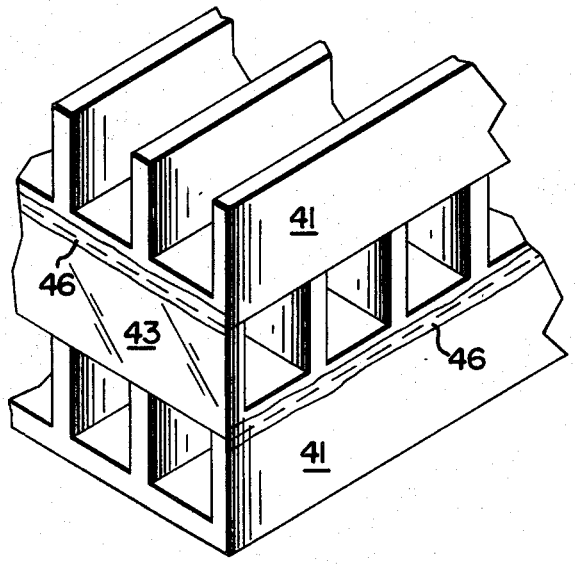

COMPOSITE CERAMIC CELLULAR STRUCTURE AND HEAT RECUPERATIVE APPARATUS INCORPORATING SAME

BACKGROUND OF THE INVENTION

This invention relates to industrial heat recuperators, and more particularly relates to a heat recuperative apparatus employing a composite ceramic cross-flow heat recuperator for use on furnaces, calciners, ovens and preheaters.

Recent concern about energy conservation and rising fuel costs has caused renewed interest in industrial recuperators to recover waste heat losses and to preheat incoming combustion air to increase the efficiency of furnaces, calciners, ovens and preheaters.

While such recuperators are usually constructed from metal parts, the ceramic recuperator has several advantages over conventional metallic recuperators. For example, ceramics in general have high corrosion resistance, high mechanical strength at elevated temperatures, low thermal expansion coefficients (TEC'S) and good thermal shock resistance, and thus exhibits excellent endurance under thermal cycling; are light in weight (about ⅓ the weight of stainless steel); and are cost competitive with high temperature alloys.

Furthermore, ceramic recuperators are available in a variety of shapes, sizes, hydraulic diameters, (hydraulic diameter is a measure of cross-sectional area divided by wetted perimeters) and compositions. Because their TEC'S are typically lower than those of most metals and alloys, however, ceramic recuperators present a compatibility problem to the design engineer desiring to incorporate them into existing furnace, calciner, oven and preheater structures.

In co-pending U.S. patent application Ser. No. 686,040, filed May 13, 1976, and assigned to the present assignee, there is described a cross-flow ceramic recuperator employing a single ceramic composition. The relatively high cell density of the disclosed structures (for example, 125 cells per square inch) enabled use of such recuperators in forced draft applications, permitting relatively small hydraulic diameters. Where larger hydraulic diameters and/or larger size recuperators are desired (for example, in natural draft applications where back pressures on the order of 0.1 inch of water are desired), fabrication problems are encountered. For example, consideration has been given to assembling large recuperator structures by building them up from blocks or sections of smaller size. However, an attendant problem has been leakage of the heat transfer fluids between subsections or component parts, resulting in the decreased overall efficiency of the recuperative apparatus.

SUMMARY OF THE INVENTION

In accordance with the invention, a composite ceramic cross-flow recuperator composed of a plurality of sectioned ribbed layers sealed together, is incorporated into a metallic housing adapted for coupling to the metallic fittings of existing furnaces, calciners, ovens and preheaters. Sealing means between the layer sections prevents leakage of heat transfer fluids such as exhaust flue gases and incoming combustion air, and thus minimizes heat loss, between core layers.

In accordance with a preferred embodiment, the sealing means comprises an effectively fluid-impervious ceramic cement of a lower melting material than that of the layer material, which cement is plastic at the firing temperature used to sinter the ceramic recuperator structure.

In accordance with another preferred embodiment, the seal is achieved by use of the ceramic cement between the layer sections and adjacent reinforcing members of a material similar to that of the layer material, the reinforcing members positioned adjacent the outer ribs of abutting layer sections.

In accordance with yet another preferred embodiment, a coating of the ceramic cement is located on continuous bond lines of the external surfaces of the ceramic cellular structure assembly to seal alternate sectioned layers from one another.

The recuperative apparatus is useful to preheat incoming heating or combustion air and/or fuel and thus increase the efficiency of existing furnaces, calciners, ovens and preheaters of varying types and sizes.

BRIEF DESCRIPTION OF THE DRAWINGS

FIG. 1 is a perspective view of one embodiment of a recuperative ceramic cellular structure of stacked ribbed bi-sectional layers;

FIG. 2 is a front elevation view of a portion of one bi-sectioned ribbed layer showing abutting sections having the outer ribs between an inverted U-shaped channel as one embodiment of means for sealing the sections together;

FIG. 3 is a front elevation view similar to that of FIG. 2, showing another embodiment of means for sealing the layer sections;

FIG. 4 is a front elevation view, showing yet another embodiment of a means for sealing the layer sections;

FIG. 5 is a perspective view, cut away, of a portion of the outer surface of the stacked structure of FIG. 1 showing a coating of cement on the continuous bond lines between alternate layers;

DETAILED DESCRIPTION OF THE INVENTION

Figure 6:
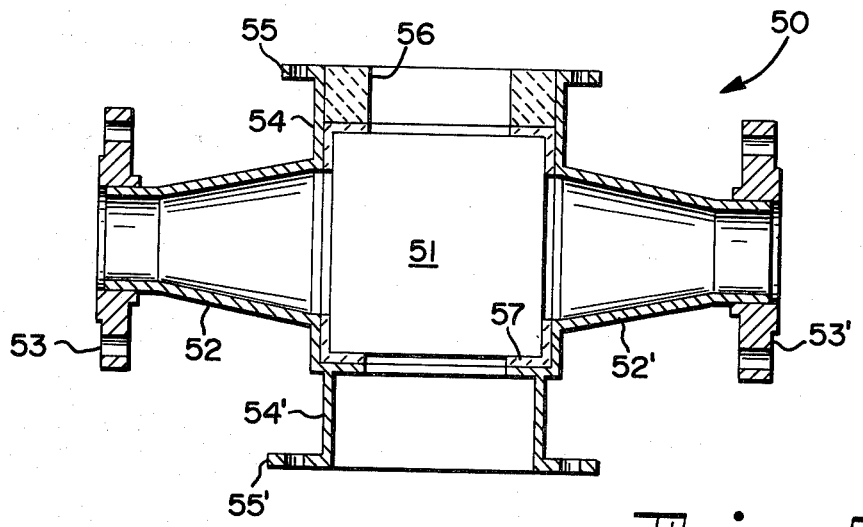
FIG. 6 is a front elevation view, in section, of one embodiment of a heat recuperative apparatus of the invention, wherein the recuperator of a composite ceramic structure of stacked ribbed bi-sectioned layers is held within a metallic housing.

For a better understanding of the present invention, together with other and further objects, advantages and capabilities thereof, reference is made to the following disclosure and appended claims in connection with the above-identified drawings.

Referring now to FIG. 1 of the drawings, there is shown one embodiment of the composite ceramic recuperator structure 10 of the invention. This ceramic structure is made up of a plurality of stacked ribbed bi-sectioned layers, 11 and 13, positioned so that the ribs of layers 11 and 13 are transverse to one another. The ribbed sections 11, 11*a*, 13 and 13*a* may be formed by casting, molding, extruding, tape casting and embossing, or other suitable ceramic forming technique. These ribbed sections, referred to as being in the unfired or "green" state, are then sealed together in the following manner. Channel-shaped members 12 and 12' of a material similar to that of the ribbed sections, which may have been formed by a similar or dissimilar ceramic forming technique, and of a length dimension substantially identical to the length dimension of the ribbed sections, are filled with a ceramic cement 15. The ceramic cement 15 is preferably of a material having a lower melting point than that of the section and channel materials so that at the firing temperatures encountered at a later stage in processing, the cement will assume a plastic state, flowing into irregularities in the bonding surfaces of the ribs and channel and thereby achieving an adequate seal between the sections. The channel is filled with the cement and fitted over the outer ribs of abutting sections. FIG. 2 shows the seal structure in more detail. It will be noted from FIG. 2 that the outer ribs 11' and 11a' are of a height lower than that of the remaining ribs in order that the top surface of the channel 12, when positioned in place will contact the lower surface of the base portion of the next sectioned layer. The process of assembling the bi-sectioned layers is repeated and the resulting layers are stacked so that the ribs of alternate layers are transverse to one another. In a preferred embodiment, the ribbed sections have length dimensions approximately twice that of their width dimensions so that the resulting stacked structure has a square cross-section and may be built up to an approximate cubic configuration. The stacked layers are then fired in the conventional manner (within the sintering range but below the melting temperature of the materials) to convert the green ceramic materials into a polycrystalline ceramic body. During firing, the stacked layers bond together by sintering at points or areas of contact, resulting in a unitary structure having mechnical strength. Nevertheless, deviations from planarity of the stacked green layers result in incomplete sintering together of these layers, leaving voids or cracks along the contact or bonding surfaces. Such voids or cracks may be evident at the visible edges or "bond lines" of the bonding surface between the outermost rib of one layer and the flat surface of the base portion of an adjacent layer. In accordance with a preferred embodiment, these bond lines are covered with layers or coatings 46 of the ceramic cement prior to firing, as shown in FIG. 5. Alternate stacked ribbed layers 41 and 43 form the cross-flow paths for the heat transfer fluids.

In FIG. 3 is shown another embodiment of a sealing means for the layer sections, in which a I-beam shaped member 22 is located on shelf portions 21' and 21a' of the abutting layers 21 and 21a extending beyond the outermost ribs of the abutting layers. Cement 15 surrounds the I-beam shaped member and is also located in a space between the abutting shelf portions 21' and 21a'. It will be noted that the outermost ribs in this embodiment are of the same height as the other ribs of the sections. FIG. 4 shows yet another embodiment of a sealing arrangement in which a more massive beam member 32 is used. This member 32 has dimensions such that its top surface may contact the lower surface of the base portion of the next layer, which may be desired for added support, for example, where thin walled structures are employed.

Other details of the cross-sectional configurations of the stacked recuperator structure will be dependent upon the particular application envisioned, including such considerations as furnace type and design, furnace operating conditions, recuperator size required, etc. In general, however, for natural draft conditions, the hydraulic diameter will fall within the range of approximately 0.5 to 1.50 inches, the cell wall thicknesses will range from about 0.025 inches to about 0.10 inches, and the aspect ratio (the ratio of the height to the width of the cells) will fall within the range of about 0.1 to 1.

It will of course be appreciated by those skilled in the art that in order to maximize the efficiency of heat transfer, the heat transfer surface should be maximized. This may be achieved by both narrowing the width and reducing the number of the supporting ribs, both of which adjustments would result in a reduced aspect ratio, that is, increased width of the cells verses height of the cells. Attendant mechanical weakening of the structure could be at least partially overcome by reducing the height of the cells, further reducing the aspect ratio. However, the undesirable condition of excessive back pressure limits the ability to maximize the heat transfer surface in which manner. Accordingly, the aspect ratio should be maintained within the range of about 0.1 to 1, below which excessive back pressures would be encountered and above which the effective heat transfer surface would be undesirably reduced.

Exemplary materials and conditions for forming a cellular recuperative structure suitable for use in a heat recuperative system will now be presented. Such materials and conditions are in no way limiting or necessary to the successful practice of the invention, but are merely presented to aid the practitioner in the production of a preferred embodiment of the invention.

A ceramic composition having the raw materials in the proportions shown in Table I was formed and extruded through a die to form ribbed layers and channel members for later sealing and stacking into a recuperative structure.

TABLE I

| RAW MATERIAL | WEIGHT PERCENT |
|---|---|
| Talc (S. #200) | 38.40 |
| Talc (W. #6) | 18.33 |
| Tenn. Ball Clay | 14.23 |
| Alumina | 23.53 |
| Extruding aids | 5.51 |

Typical approximate compositions of the raw materials in weight percent is shown in Table II.

TABLE II

| | TYPICAL APPROXIMATE COMPOSITION (IN WT. PERCENT) OF RAW MATERIALS | | | |
|---|---|---|---|---|
| | TALC (S.#200) | TALC (W. #6) | TENN. BALL CLAY | ALUMINA |
| $Si_O2$ | 61.0 | 73.84 | 58.13 | 0.08 |
| MgO | 32.0 | 0.02 | 0.30 | — |
| $Al_2O_3$ | 0.5 | 20.15 | 27.16 | 99.7 |
| $Fe_2O_3$ | 0.5 | 0.07 | 1.18 | 0.30 |
| $TiO_2$ | 0.03 | 0.15 | 1.93 | — |
| CaO | 0.2 | 0.06 | 0.05 | — |
| $Na_2O$ | — | 0.20 | 0.18 | 0.06 |
| $K_2O$ | — | 1.54 | 0.57 | — |
| Ignition Loss | 5.3 | 4.00 | 10.51 | — |
| $H_2O$ | 5.0 | — | — | — |

The combined weight percents on an oxide basis of the compositions is shown in Table III.

TABLE III

| OXIDE | WEIGHT PERCENT |
|---|---|
| $Si_02$ | 50.23 |
| MgO | 13.69 |
| $Al_2O_3$ | 34.64 |
| $Fe_2O_3$ | 0.49 |
| $TiO_2$ | 0.35 |
| CaO | 0.11 |
| $Na_2O$ | 0.09 |
| $K_2O$ | 0.40 |

The composition shown in Table III melts at approximately 1430° C. and fires at approximately 1400° C. The extruded porosity of the "green" ribbed layers and channel members was measured by a mercury porosimeter technique as approximately 20 percent. The interconnected porosity (that which forms a continuous channel or void from one surface to another of the extruded material) was found to be effectively undetectable to air using a conventional soap solution test. The channel members were then filled with a ceramic cement formed from raw materials in the amounts shown in Table IV.

TABLE IV

| RAW MATERIAL | WEIGHT PERCENT |
|---|---|
| Talc (S. #200) | 41.61 |
| Talc (W. #6) | 27.87 |
| Alumina | 29.04 |
| Plasticity vehicle | 1.48 |

The composition expressed as the component oxides in weight percent is shown in Table V.

TABLE V

| OXIDE | WEIGHT PERCENT |
|---|---|
| $SiO_2$ | 48.39 |
| MgO | 14.02 |
| $Al_2O_3$ | 36.59 |
| $Fe_2O_3$ | 0.33 |
| $TiO_2$ | 0.05 |
| CaO | 0.11 |
| $Na_2O$ | 0.07 |
| $K_2O$ | 0.45 |

This composition melts at 1410° C. and becomes plastic within the range of about 1370° C. to 1400° C.

The ribbed layers were cut into sections having length dimensions (the dimension parallel to the ribs) approximately twice the width dimension. Approximately square layers were then formed by abutting two ribbed layers together along their length dimensions, and by placing the cement-filled channel member over the outermost ribs of the abutting layer sections. The square layers were then stacked so that the ribs of alternate layers were transverse to one another, and so that the overall height of the stacked structure was approximately equal to the length and width dimensions, forming an approximately cubic stacked structure. The structure was fired at approximately 1400° C., at which the cement took on a plastic state and wetted the surfaces of the contact layers.

The fired assemblies were then tested for leakage by incorporating them into a metallic housing of the type shown in FIG. 6, attaching one outlet of the housing to a blower and sealing the opposite communicating outlet. Thus, air forced into the recuperative structure could exit through the remaining outlets of the housing only by leaking into alternate transverse layers whose cells communicated with these unrestricted outlets. Visual inspection indicated acceptable leakage.

Referring now to FIG. 6, there is shown a recuperative apparatus 60 in which the completed ceramic structure 61 is incorporated into a metallic housing 62.

The metallic housing 62 may be formed of a single casting, or of machined and welded parts, and is preferably of a corrosion resistant metal such as stainless steel in corrosive applications and above 600° F. housing outer skin temperatures. Tapered conduit portions 52 and 52' terminate in flanged portions 53 and 53' for connection into the incoming heating or combustion air or fuel line. Sidewall portions 54 and 54' define openings terminating in flanged portions 55 and 55' for connection into the exhaust heat or flue gas outlet. The ceramic recuperator is thus heated by the passage of hot exhaust gases through it, and incoming cold air or fuel is in turn preheated as it passes through in the transverse direction.

Because of the large differences in thermal expansion coefficients between most ceramics and most metals, and the relatively high thermal conductivity of most metals relative to most ceramics, seal 57, having both resilient and insulating properties is used to maintain an effectively gas-impervious seal between the ceramic core 51 and the metallic housing 50. A detailed description of such a composite seal is not a necessary part of this invention. An example of a composite seal suitable for use in the apparatus of this invention is described in detail in Ser. No. 686,040, referred hereinabove.

Sidewall portion 54 of the metallic housing defines an opening just large enough to admit the recuperator cellular structure 51 and seal 57 after expansion of the metallic housing by moderate heating. Thus, upon cooling, a force fit is achieved. After placement of the structure in the housing, a ceramic insert 56, preferably cast in situ, is positioned atop the structure to contact the mating surface of a ceramic lining of an exhaust or flu gas opening or conduit. Flange 55 connects to the flu gas conduit or furnace housing and maintains the ceramic members in intimate contact.

Figure 7:
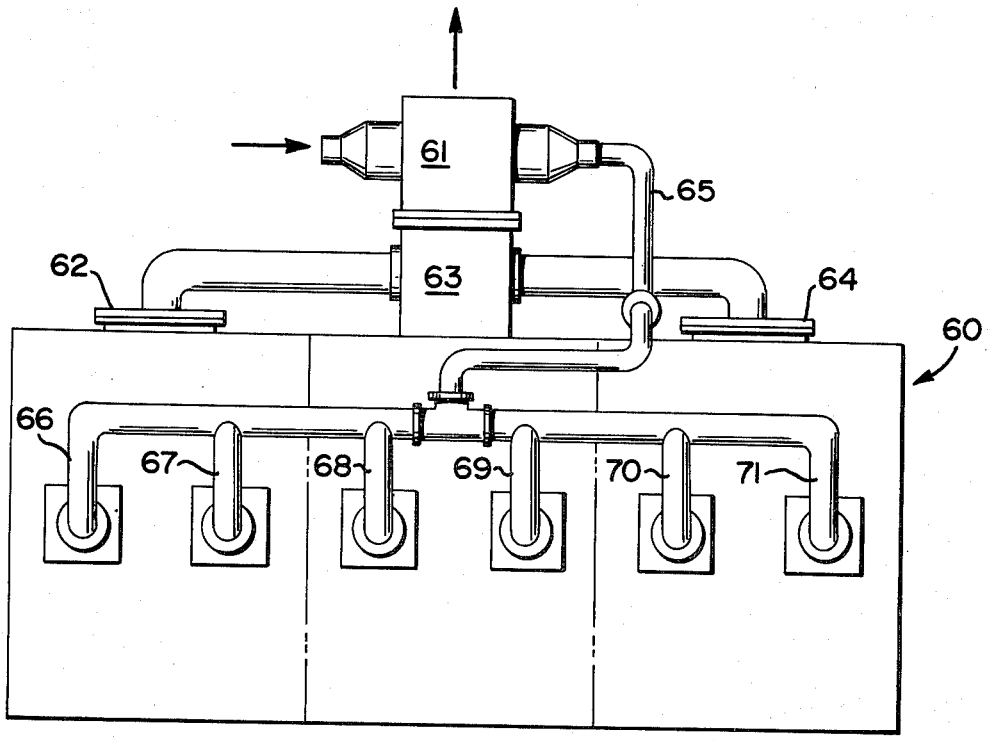
FIG. 7 is a schematic diagram of a heat recuperative system employing two recuperative apparati of the invention on a two-burner horizontal radiant tube furnace.

Referring now to FIG. 7, there is shown in schematic form an arrangement whereby recuperator 61 is installed on the exhaust ports 62, 63 and 64 of a three zone natural draft tunnel furnace 60. Preheated combustion air is supplied through conduit 65 to burner inlets 66, 67, 68, 69, 70 and 71. This is of course but one example of numerous arrangements which may be used to realize the advantages of the invention. Furnaces, ovens, calciners and preheaters of any design may incorporate one or more of these recuperative apparati in order to improve efficiency of operation.

While there has been shown and described what are at present considered the preferred embodiments of the invention, it will be obvious to those skilled in the art that various changes and modifications may be made therein without departing from the scope of the invention as defined by the appended claims. For example, the substantial rectangular cell cross-sections could be replaced by a sinusoidal configuration produced by contacting corrugated and flat layers.

What is claimed is:

1. A composite cross-flow recuperative ceramic cellular structure, having first and second pairs of opposing faces defining cell openings for the passage of heat transfer fluids, respectively, in directions transverse to one another, the first fluid transferring heat to the second fluid during passage through the cells, whereby each pair of faces has in operation a hot face and a cold face, the hot face of the first pair being the inlet face for the first fluid, and the hot face of the second pair being the outlet face for the second fluid, characterized in that the ceramic cellular structure is a composite of a plurality of sectioned stacked ribbed layers, the layer sections in abutting relationship, the layers stacked so that the ribs of alternate layers are transverse to one another, and sealing means between abutting layer sections, the sealing means substantially preventing leakage of heat transfer fluids between adjacent layers.

2. The composite ceramic cellular structure of claim 1 in which the sealing means comprises an effectively fluid-impervious ceramic cement.

3. The composite ceramic cellular structure of claim 2 in which the ceramic cement is a material having a lower melting point than the melting point of the layer material.

4. The composite ceramic cellular structure of claim 3 in which reinforcing members are provided, the members being of a material similar to that of the layer material, and positioned adjacent the outer ribs between abutting layer sections, and in which cement is positioned between the outer ribs of the layer sections and the reinforcing members.

5. The composite ceramic cellular structure of claim 4 in which the reinforcing members comprise inverted U-shaped channels of a length approximately equal to the length of the ribs and of approximately the same thickness as the thickness of the ribs, and in which the outer ribs between the abutting layer sections are of a height slightly smaller than the difference between the height of the remaining ribs and the thickness of the channels, so that the upper surfaces of the channels contact substantially the lower surfaces of the base portions of adjacent layers.

6. The composite ceramic cellular structure of claim 4 in which the reinforcing members comprise I-shaped beams of a length approximately equal to the length of the ribs, and in which the base portions of the layer sections extend beyond the outer ribs to form abutting shelf portions, and in which the I-shaped beams are positioned on these shelf portions between the outer ribs.

7. The composite ceramic cellular structure of claim 6 in which the I-shaped beams have a height slightly smaller than the height of the ribs, so that the upper surfaces of the beams substantially contact the lower surfaces of the base portions of adjacent layers.

8. The composite ceramic cellular structure of claim 3 in which coatings of the ceramic cement are located on the external surfaces of the composite structure over the continuous bond lines between alternate layers.

9. A heat recuperative apparatus comprising a cross-flow recuperative ceramic cellular structure, having first and second pairs of opposing faces defining cell openings for the passage of first and second heat transfer fluids, respectively, in directions transverse to one another, the first fluid transferring heat to the second fluid during passage through the cells, whereby each pair of faces has in operation a hot face and a cold face, the hot face of the first pair being the inlet face for the first fluid, and the hot face of the second pair being the outlet face for the second fluid, a metallic housing surrounding the cellular structure, the housing defining openings communicating with the structure cell openings, the housing openings adapted for coupling to external fluid conduits, and means for maintaining a seal between the cellular structure and the housing to promote passage of the heat transfer fluids through the structure cells;

characterized in that the ceramic cellular structure is a composite of a plurality of sectioned stacked ribbed layers, of a material having a melting temperature greater than a preselected temperature of operation of the apparatus, the layer sections in abutting relationship, the layers stacked so that the ribs of alternate layers are transverse to one another, and sealing means between abutting layer sections, the sealing means substantially preventing leakage of heat transfer fluids between adjacent layers.

10. The heat recuperative apparatus of claim 9 in which the sealing means comprises an effectively fluid-impervious ceramic cement.

11. The heat recuperative apparatus of claim 10 in which the ceramic cement is a material having a lower melting point than the melting point of the layer material.

12. The heat recuperative apparatus of claim 11 in which reinforcing members are provided, the members being of a material similar to that of the layer material, and positioned adjacent the outer ribs between abutting layer sections, and in which cement is positioned between the outer ribs and the reinforcing members.

13. The heat recuperative apparatus of claim 12 in which the reinforcing members comprise inverted U-shaped channels of a length approximately equal to the thickness of the ribs, and of approximately the same thickness as the thickness of the ribs, and in which the outer ribs between the abutting layer sections are of a height slightly smaller than the difference between the height of the remaining ribs and the thickness of the channels, whereby the upper surfaces of the channels substantially contact the lower surfaces of the base portions of adjacent layers.

14. The heat recuperative structure of claim 12 in which the reinforcing members comprise I-shaped beams of a length approximately equal to the length of the ribs and in which the base portions of the layer sections extend beyond the outer ribs to form abutting shelf portions and in which the shaped beams are positioned on these shelf portions between the outer ribs.

15. The heat recuperative structure of claim 14 in which the I-shaped beams have a height slightly smaller than the height of the ribs, so that the upper surfaces of the beams substantially contact the lower surfaces of the base portions of adjacent layers.

16. The heat recuperative structure of claim 11 in which coatings of the ceramic cement are located on the external surfaces of the composite structure over the continuous bond lines between alternate layers.

* * * * *